US006390779B1

(12) United States Patent
Cunkelman

(10) Patent No.: US 6,390,779 B1
(45) Date of Patent: May 21, 2002

(54) INTELLIGENT AIR COMPRESSOR OPERATION

(75) Inventor: Brian L. Cunkelman, Blairsville, PA (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 09/120,701

(22) Filed: Jul. 22, 1998

(51) Int. Cl.[7] ..... F04B 49/00
(52) U.S. Cl. ..... 417/14; 417/63
(58) Field of Search ..... 417/18, 19, 22, 417/63, 153

(56) References Cited

U.S. PATENT DOCUMENTS 4,443,156 A * 4/1984 Dunnam, Jr. ..... 417/19 X
4,913,625 A * 4/1990 Gerlowski ..... 417/18
5,106,270 A * 4/1992 Goettel et al. ..... 417/243
5,310,020 A * 5/1994 Martin et al. ..... 184/6.3
5,422,824 A * 6/1995 Biehler et al. ..... 364/494
5,894,881 A * 4/1999 Wagner et al. ..... 417/14 X
5,989,312 A * 11/1999 Barnhard et al. ..... 95/8
6,027,311 A * 2/2000 Hill et al. ..... 417/53
6,102,665 A * 8/2000 Centers et al. ..... 417/18

* cited by examiner

*Primary Examiner*—Timothy S. Thorpe
*Assistant Examiner*—Michael K. Gray
(74) *Attorney, Agent, or Firm*—James Ray & Associates

(57) ABSTRACT

Apparatus for and method of monitoring the condition of an air compressor. The apparatus includes a plurality of appropriately located sensors for sensing operating parameters of the air compressor and for outputting signals indicative of the condition of each of the operating parameters. An information processor is connected to receive the output signals from the sensors and to communicate output control signals in response thereto. The control signals contain information that allows appropriate control and maintenance of the air compressor.

17 Claims, 2 Drawing Sheets

INTELLIGENT AIR COMPRESSOR OPERATION

FIELD OF INVENTION

The present invention relates, in general, to air compressors and, more particularly, this invention relates to air compressors used on locomotives for supplying compressed air to brake systems and other uses and, still more particularly, it relates to an air compressor arrangement in which a computer or microprocessor is employed to read the outputs of sensors located at critical locations on and/or in the air compressor and its associated apparatus for the purpose of providing information on the operating condition of the air compressor and such associated apparatus and for shutting down the compressor upon the occurrence of a critical event.

BACKGROUND OF THE INVENTION

Air compressors in locomotives supply pressurized air to the brake equipment disposed on the locomotives and any railway cars connected to the locomotives as well as for other air utilizing systems (such as air operated horns). The operation of the air compressor is critical in that without the pressurized air supplied by the compressor the locomotive and cars cannot be braked for slowing and stopping purposes. Yet, as a component located in a locomotive, the compressor is generally unattended other than when appropriate checks and maintenance procedures are undertaken.

The air compressor in a locomotive per se operates under the control of a governor. Such governor senses the need for increased air pressure and orders the compressor to supply such air pressure. In addition, when the air pressure has been re-supplied to a certain predetermined psi level, the governor turns off the air compressor.

When the air compressor is off, residual air in the compressor and associated components can be unloaded by operation of a magnet valve in an unloader line so that the air compressor, when ordered to restart, does not have to start against such residual pressure. This protects the electric motor employed to drive the compressor, if the compressor is driven by such a motor, i.e., some compressors are driven directly off the diesel engine of the locomotive, as is well known in the railway art.

SUMMARY OF THE INVENTION

What is therefore needed in the locomotive air compressor art and what the present invention supplies is a means for diagnosing the operating conditions and parameters of an air compressor, and reporting the same to an operator/engineer of the locomotive as well as providing controls that will stop the air compressor in the event of a critical event, such as excessive air pressure, excessive compressor or motor temperature or a loss of oil and/or oil pressure in the compressor. This is effected by locating a plurality of sensors at critical locations in association with the air compressor and in any apparatus associated therewith. Such sensors output electrical signals to an information processor having embedded therein electrical controls and information providing architecture that are effective for purposes, such as (1) continuing normal compressor operations, (2) noting the need for routine and/or extraordinary compressor maintenance and (3) ordering shut-down of the compressor.

OBJECTIVES OF THE INVENTION

It is, therefore, an objective of the invention to provide an "intelligent" air compressor capable of providing its own diagnostics of critical conditions occurring in the compressor.

Another objective is to provide a computer, or a dedicated microprocessor, having circuit architecture that permits the incorporation of features to provide automatic protection of an air compressor as well as the automatic supply of information to an operator of a locomotive concerning the condition of the air compressor.

Still another objective is to provide an information processor that enables the user thereof to load and unload an air compressor, to start and stop the air compressor and to note the occurrence of both a cut-in and a cut-out of such air compressor.

A further objective is to provide a computer or microprocessor that reports the need for maintenance of the air compressor, which maintenance may include the replacement of degraded components.

Another objective of the invention is to use a computer in the cab of a locomotive, or a dedicated microprocessor in the locomotive, that will call for the shutdown of an air compressor in the locomotive on the occurrence of a critical event, such as low oil pressure in the compressor, overheating of the compressor or a worn component in the air compressor as sensed by appropriate sensors.

Yet another objective is to provide a system that will monitor the quality of the compressed air entering the locomotive compressed air system.

Still yet another objective is to provide a system in which the temperature, humidity, oil and particulate content can be measured.

In addition to the objectives and advantages listed above, various additional objectives and advantages of the intelligent air compressor operation system will become more readily apparent to those persons who are skilled in the air compressor art from a reading of the detailed description section of this document. These additional objectives and advantages will become particularly apparent when such description is taken in conjunction with the attached drawing Figures and with the appended claims.

Figure 1:
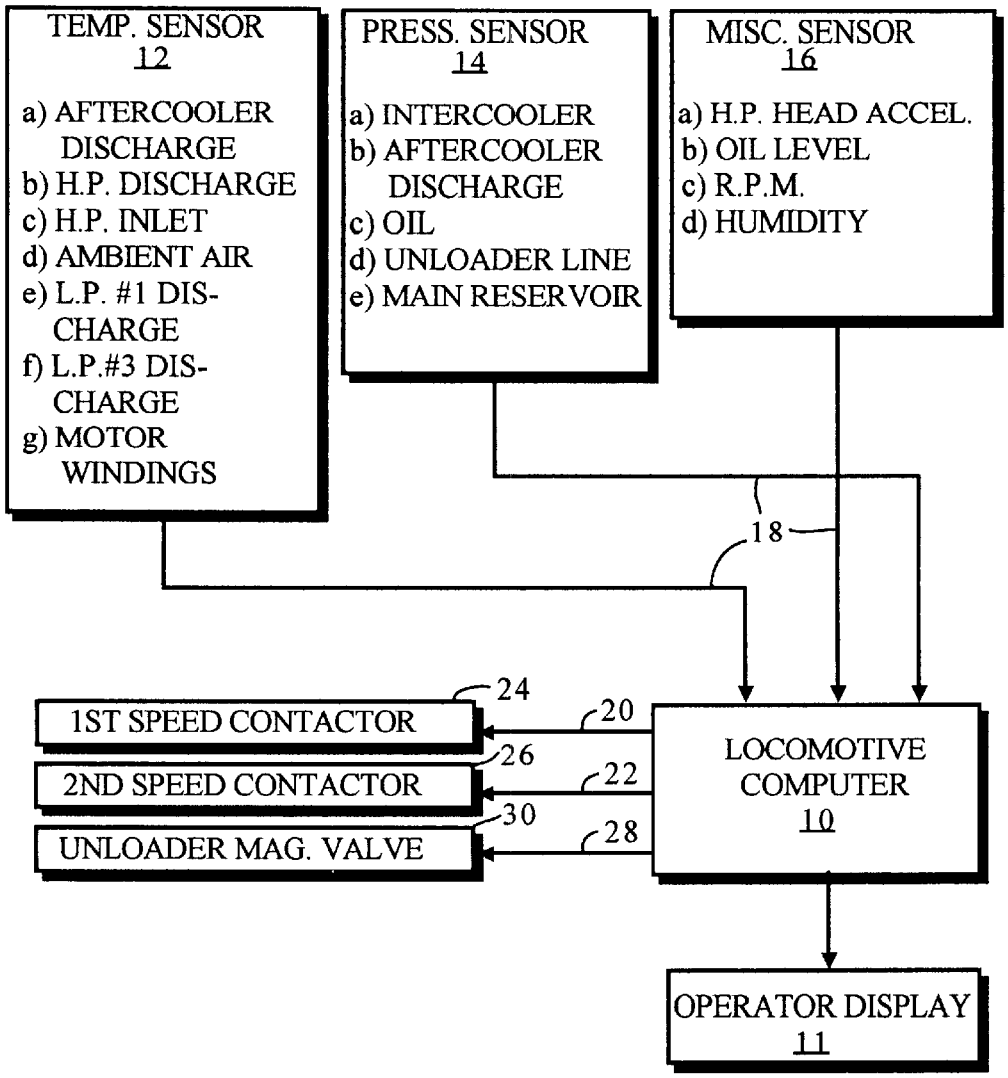
FIG. 1 is a schematic representation of the processes of the invention using a plurality of sensors and a locomotive computer connected to receive outputs of such sensors and use the same in response thereto.

BRIEF DESCRIPTION OF A PRESENTLY PREFERRED AND VARIOUS ALTERNATIVE EMBODIMENTS OF THE PRESENT INVENTION

Prior to proceeding to the more detailed description of the present invention, it should be noted that identical components having identical functions have been designated with identical reference numerals throughout the drawing Figures for the sake of clarity and understanding of the invention.

Refer now, more particularly, to the drawings, wherein a schematic diagram of the system and processes of the invention are presented. As shown therein an information processor, such as a locomotive computer 10, or a dedicated microprocessor 40 (FIG. 2), which can be a portable laptop computer, for example, is electrically connected to a plurality of sensors generally designated by numerals 12, 14 and 16 in the figures and by the parameter titles of "temperature," "pressure" and "miscellaneous." Under such respective numerals and titles are listed a plurality of operating parameters of an air compressor (which is not otherwise depicted in the drawings).

Figure 2:
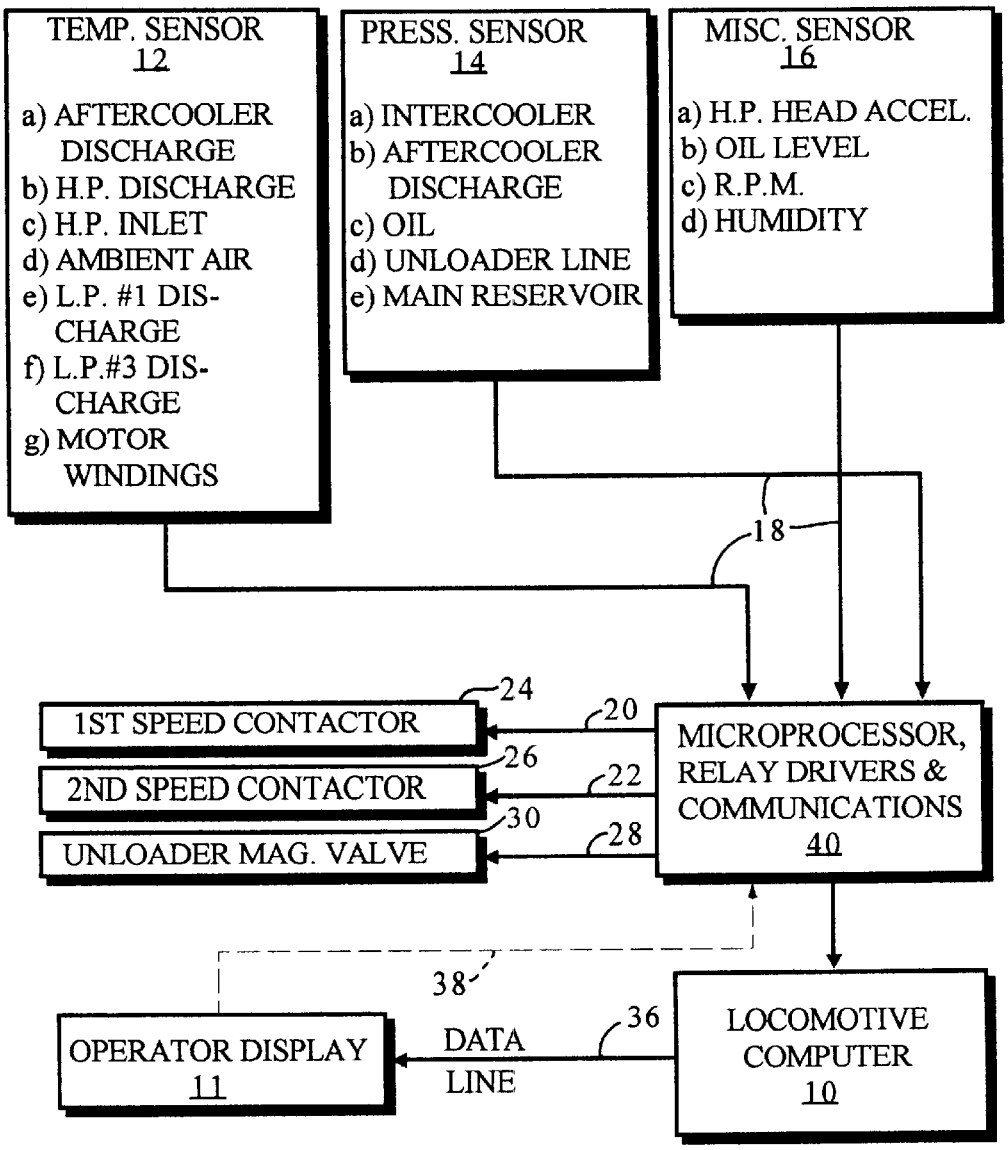
FIG. 2 is a schematic representation similar to that of FIG. 1 except that a dedicated microprocessor is used to receive sensor outputs and use the same in response thereto.

The lists of parameters in FIGS. 1 and 2 are not intended to be exhaustive, as a locomotive air compressor has a substantial number operating parameters, as well as a number of associated components whose parameters can also be monitored by the system of the invention.

A display means 11 is shown electrically connected to the computer 10 for providing the operator of the locomotive with instructions and information regarding the operation of the locomotive.

If the compressor being monitored is of a type disclosed in U.S. Pat. No. 5,106,270 to Goettel et al., such compressor is driven by an electrical motor. The compressor, in addition, has two respective pistons that reciprocate in two respective low pressure (LP) cylinders and a third piston that reciprocates in a high pressure (HP) cylinder. The LP cylinders output compressed gases to two intermediate, integral intercoolers while the output of the high pressure HP cylinder is directed to an integral aftercooler. The intercoolers and aftercooler reduce the temperature of the compressed gases. The aftercooler reduces the high pressure gas temperature to near ambient before being discharged to a main locomotive reservoir.

In FIGS. 1 and 2, the list of operating parameters is also a list of sensors (not otherwise shown in the drawings) for sensing the operating parameters listed. As such, respective lower case alphabetical designations are provided under the general headings of 12, 14 and 16. The plurality of sensors sense the levels of the respective parameters, and these "levels" are the data inputs 18 to such locomotive computer 10 (shown in FIG. 1) or to the dedicated microprocessor 40 (shown in FIG. 2), and the outputs of such sensors are electrically or optically connected to appropriate input portions of the computer 10 or microprocessor 40 architecture.

Computer 10, in addition to providing an operator with a display 11 of instructions and information on the operation of the locomotive, provides a plurality of outputs in response to the inputs, from the sensors for the purposes and objectives of the invention.

For example, if the air compressor is driven by a multiple speed electric motor (not shown per se), the computer 10 provides an appropriate motor control output, in response to receipt of an RPM signal 16*c* for reasons explained hereinafter as indicated in the drawings by numerals 20 and 22, using relay drivers and communications architecture embedded in the computer firmware. Electrical power to such a motor is supplied through a like plurality of electrical contactors (24 and 26 in the drawings) receiving instructions from the computer 10, via the respective outputs 20 and 22.

Similarly, computer 10 has a relay driver for providing a magnet valve output 28 for controlling the operation of a typical magnet valve 30. Such magnet valve 30 is used to load and unload the air compressor, using pressure signals provided by main reservoirs located on the locomotive via unloader lines. A main reservoir and an unloader line are represented in the drawings by the lower case letters d and e, respectively, under the heading "PRESS. SENSOR 14." Computer 10 receives the reservoir and unloader line pressure data from sensors located to measure such reservoir and unloader line pressure levels, which are employed to operate magnet valve 30.

As thus far described, the main computer 10 disposed in the cab of a locomotive is employed to provide the control and maintenance of the locomotive's air compressor. In FIG. 2 of the drawings, such a computer is still represented schematically by a box or rectangle 10 connected to a display 11. However, the computer in FIG. 2 is connected to receive output data 36 from a dedicated microprocessor 40 connected to receive sensor outputs from 12, 13 and 14. The computer in FIG. 2 can present microprocessor 40 information and instructions on display 11 or the output of the microprocessor 40 can be sent directly to the display 11 via a direct data connection 38.

Microprocessor 40 is dedicated solely to the process of monitoring operating parameters of a locomotive air compressor and providing, inter alia, the information and controls described above in connection with the computer 10. Like computer 10 the microprocessor 40 has embedded firmware in the form of relay drivers and communications architecture that permits the microprocessor 40 to receive inputs and operate the contactors 24 and 26 and magnet valve 30 in response to such inputs and to communicate to the outside world the nature of needed information relating to the compressor.

For example, in noting (sensing) the RPM of the compressor operated by a multiple speed motor, the microprocessor 40 orders unloading of the compressor via magnet valve 30 so that a change from one speed to another (using contactors 24 and 26) need not be made against residual air in the compressor. A number of pulse producing devices are available for measuring (sensing) rotational (RPM) speed, the frequency of the pulses being an indication of speed.

The operation of the processes of the invention is further described in direct reference to drawing details, though all of the operating parameters shown and sensed in the drawings need not be described in detail to understand the invention. Further, as discussed above, other parameters can be sensed, as the lists in the drawings are not intended to be exhaustive and computer 10 or microprocessor 40 can be made and programmed to operate in response to such other parameter sensor outputs.

In the drawings, seven operating temperatures 12 are presented for sensing by seven sensors a through g. The temperature of the air discharge of an aftercooler, for example, can be sensed by a sensor 12*a* which is indicative of the effectiveness of such an aftercooler in reducing compressor output air temperature to near ambient for the purpose of condensing water vapor contained in such compressor output to liquid water for removal of the same from the compressed air system of the locomotive. It is particularly imperative that water be removed before air is sent to the air brake systems of railroad locomotives and cars to ensure proper functioning of such air brake systems. In freezing conditions, such water can freeze in the brakes thereby directly affecting their operation.

Water, in addition, causes rust and corrosion of the brake components, thereby indirectly adversely affecting brake operation. If aftercooler discharge air temperature is too high, a problem exists in the aftercooler such as clogged heat exchange tubes in the aftercooler. Similarly, if the discharge temperatures 12*b, e* and *f* of the high and low pressure cylinders of the compressor are excessive, a problem exists in the compressor, intercooler or discharge valves of the cylinders for consideration by the operator.

Monitored by the temperature sensor 12*g,* the temperature of the windings of the compressor motor can be an indication of motor overload, in which case electrical power to the motor can be automatically interrupted using contactors 24 or 26, operated on instructions from the computer 10 or the microprocessor 40. Computer 10, or microprocessor 40, receives these and other signal outputs from the sensors as inputs over data lines 18 to present this information to a locomotive engineer via the display device 11, and to order the immediate shut down of the compressor motor if motor windings are overheating.

Similarly, an accelerometer 16*a* can be located in the high pressure head of the compressor to sense a worn wrist pin bearing. Such a worn wrist pin bearing vibrates, which vibration is sensed by the accelerometer 16*a*. The accelerometer 16*a* produces an electrical signal representing such vibration, which is sent over a data line 18 to the computer 10, or microprocessor 40. The computer 10, or microprocessor 40, outputs a signal to the display device 11 indicating the existence of such a worn wrist pin bearing and can order shutdown of the compressor motor if the bearing is in a critically worn condition.

Computer 10, or microprocessor 40, can similarly order a compressor shut-down if the compressor oil pressure, as sensed by sensor 14*c*, is below a critical level or if the actual amount of oil, as monitored by sensor 16*b*, in the compressor is sensed as being too low or nonexistent. A suitable sensor for measuring the oil level can be a simple flotation device, though more sophisticated sensors are available and can be used.

While presently preferred embodiments for carrying out the instant invention have been disclosed in detail above, those persons skilled in the locomotive compressor art to which this invention pertains will recognize various alternative ways of practicing the invention without departing from the spirit and scope of the claims appended hereto.

I claim:

1. An apparatus for monitoring operating conditions of an air compressor disposed on a railway locomotive and powered by at least one of an electric motor and a locomotive engine, such air compressor having at least one low pressure cylinder for compressing and discharging air to at least one intercooler and at least one high pressure cylinder for receiving air from such intercooler and for compressing and discharging such air to an aftercooler from which such air is conveyed to a reservoir, said apparatus comprising:

(a) a predetermined plurality of sensors appropriately located for sensing operating parameters of such air compressor, and for generating output signals indicative of a condition of each of said operating parameters, said plurality of sensors including at least a pressure sensor for measuring pressure of such intercooler and such aftercooler discharge and at least a temperature sensor for measuring a temperature of such aftercooler discharge; and (b) an information processor connected to receive said output signals from said predetermined plurality of said sensors and to communicate control signals as an output in response to receipt of said output signals from said predetermined plurality of said sensors, said control signals containing information that allows appropriate control and maintenance of such air compressor.

2. An apparatus, according to claim 1, wherein said information processor is a main computer located in a cab of a locomotive.

3. An apparatus, according to claim 1, wherein said information processor is a microprocessor located in a cab of a locomotive and dedicated to receiving said output signals from said sensors and operating in response thereto.

4. An apparatus, according of claim 1, wherein said microprocessor is a portable laptop microprocessor used to receive said output signals from said sensors.

5. An apparatus, according to claim 1, wherein said information processor includes an output section electrically connected to at least one contactor employed for supplying and interrupting electrical current to an electrical motor of such air compressor, with at least one of said control signals provided by said information processor being effective to open and close said contactor.

6. An apparatus, according to claim 1, wherein said information processor includes an output section electrically connected to a magnet valve for controlling both loading and unloading of such air compressor, with at least one of said control signals provided by said information processor being effective to operate said magnet valve.

7. An apparatus, according to claim 1, wherein said plurality of sensors includes a sensor for sensing a temperature of such air discharged from such air compressor into such aftercooler.

8. An apparatus, according to claim 1, wherein said plurality of sensors includes a sensor for sensing a temperature of such air input to such low pressure cylinder of such air compressor.

9. An apparatus, according to claim 1, wherein said plurality of sensors includes a sensor for sensing humidity of such air conveyed from such aftercooler to such reservoir.

10. An apparatus, according to claim 1, wherein said such air compressor includes a pair of low pressure cylinders and a pair of intercoolers, said plurality of sensors includes a sensor for sensing a temperature of such air between a second one of such pair of low pressure cylinders and a second one of such pair of intercoolers.

11. An apparatus, according to claim 1, wherein such air the compressor is driven by an electrical motor having windings for conducting electrical current, said plurality of sensors includes a sensor for sensing the operating temperature of such windings.

12. An apparatus, according to claim 1, wherein the plurality of sensors includes an accelerometer located in the air compressor for sensing the vibration of a vibrating component in the air compressor.

13. An apparatus, according to claim 1, wherein the air compressor contains a supply of oil for lubricating components in the compressor said plurality of sensors includes means for sensing the pressure of the supply of said oil.

14. An apparatus, according to claim 1, wherein said plurality of sensors includes means for sensing a level of oil in such air compressor.

15. An apparatus, according to claim 1, wherein an unloader line and a magnet valve interconnect such air compressor and such reservoir and said plurality of sensors includes a sensor for sensing pressure in such unloader line.

16. An apparatus, according to claim 1, wherein said plurality of sensors includes a sensor for sensing a pressure in such reservoir.

17. An apparatus, according to claim 1, wherein said plurality of sensors includes means for sensing an operating RPM of such air compressor.

* * * * *